US009970073B2

(12) United States Patent
Kawano et al.

(10) Patent No.: US 9,970,073 B2
(45) Date of Patent: May 15, 2018

(54) HOT-ROLLED, COLD ROLLED, AND PLATED STEEL SHEET HAVING IMPROVED UNIFORM AND LOCAL DUCTILITY AT A HIGH STRAIN RATE

(75) Inventors: Kaori Kawano, Osaka (JP); Yasuaki Tanaka, Osaka (JP); Toshiro Tomida, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1038 days.

(21) Appl. No.: 13/879,074

(22) PCT Filed: Oct. 18, 2010

(86) PCT No.: PCT/JP2010/068258
§ 371 (c)(1),
(2), (4) Date: Jul. 3, 2013

(87) PCT Pub. No.: WO2012/053044
PCT Pub. Date: Apr. 26, 2012

(65) Prior Publication Data

US 2013/0269838 A1 Oct. 17, 2013

(51) Int. Cl.

| | |
|---|---|
| ***C21D 8/02*** | (2006.01) |
| ***C21D 8/04*** | (2006.01) |
| ***C21D 9/46*** | (2006.01) |
| ***C21D 9/48*** | (2006.01) |
| ***C22C 38/00*** | (2006.01) |
| ***C22C 38/02*** | (2006.01) |
| ***C22C 38/06*** | (2006.01) |
| ***C22C 38/38*** | (2006.01) |
| ***C23C 2/02*** | (2006.01) |
| ***C23C 2/28*** | (2006.01) |
| ***C22C 38/24*** | (2006.01) |
| ***C22C 38/26*** | (2006.01) |
| ***C22C 38/28*** | (2006.01) |

(52) U.S. Cl.
CPC ..... *C21D 8/0221* (2013.01); *C21D 8/04* (2013.01); *C21D 8/0426* (2013.01); *C21D 8/0436* (2013.01); *C21D 8/0463* (2013.01); *C21D 9/46* (2013.01); *C21D 9/48* (2013.01); *C22C 38/001* (2013.01); *C22C 38/02* (2013.01); *C22C 38/06* (2013.01); *C22C 38/24* (2013.01); *C22C 38/26* (2013.01); *C22C 38/28* (2013.01); *C22C 38/38* (2013.01); *C23C 2/02* (2013.01); *C23C 2/28* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0221
See application file for complete search history.

(56) References Cited

U.S. PATENT DOCUMENTS

2008/0202639 A1* 8/2008 Tomida ..... B32B 15/012 148/506

FOREIGN PATENT DOCUMENTS

| | | |
|---|---|---|
| EP | 2 565 288 | 3/2013 |
| JP | 2002-80935 | 3/2002 |
| JP | 2004-084074 | 3/2004 |
| JP | 2004-277858 | 10/2004 |
| JP | 2005-305454 | 11/2005 |
| JP | 2006-161077 | 6/2006 |
| JP | 3958842 | 5/2007 |
| JP | 2007-277661 | 10/2007 |
| JP | 2008-189979 | 8/2008 |
| JP | 2008-189985 | 8/2008 |
| JP | 2008-266778 | 11/2008 |
| JP | 2008-291304 | 12/2008 |
| WO | 2007/015541 | 2/2007 |

* cited by examiner

*Primary Examiner* — Christopher Kessler
(74) *Attorney, Agent, or Firm* — Clark & Brody

(57) ABSTRACT

A multi-phase hot-rolled steel sheet has a metallurgical structure having a main phase of ferrite with an average grain diameter of at most 3.0 μm and a second phase including at least one of martensite, bainite, and austenite. In the surface layer, the average grain diameter of the second phase is at most 2.0 μm, the difference ($\Delta nH_{av}$) between the average nanohardness of the main phase ($nH_{\alpha av}$) and the average nanohardness of the second phase ($nH_{2nd\ av}$) is 6.0-10.0 GPa, the difference ($\Delta\sigma nH$) of the standard deviation of the nanohardness of the second phase from the standard deviation of the nanohardness of the main phase is at most 1.5 GPa, and in the central portion, the difference ($\Delta nH_{av}$) between the average nanohardnesses is at least 3.5 GPa to at most 6.0 GPa and the difference ($\Delta\sigma nH$) between the standard deviations of the nanohardnesses is at least 1.5 GPa.

6 Claims, No Drawings

HOT-ROLLED, COLD ROLLED, AND PLATED STEEL SHEET HAVING IMPROVED UNIFORM AND LOCAL DUCTILITY AT A HIGH STRAIN RATE

TECHNICAL FIELD

This invention relates to a hot-rolled steel sheet, a cold-rolled steel sheet, and a plated steel sheet having improved uniform ductility and local ductility at a high strain rate (under a high velocity deformation).

BACKGROUND ART

In recent years, there have been demands for decreases in the weight of automotive bodies as one measure to decrease the amount of $CO_2$ discharged from automobiles in order to protect the global environment. Decreases in weight cannot be allowed to be accompanied by decreases in the strength demanded of automotive bodies. Therefore, increases in the strength of steel sheets for automobiles are being promoted.

There are also increased societal demands for safety of automobiles in collisions. For this reason, the properties demanded of steel sheets for automobiles are not simply a high strength; there is also a desire for improved impact resistance should a collision occur during driving. Namely, there is a desire for high resistance to deformation when deformation takes place at a high strain rate. The development of steel sheets which can satisfy these demands is being studied.

In general it is known that the difference between the static stress and the dynamic stress of a steel sheet (in this invention, this difference being referred to as the static-dynamic difference) is large in steel sheets made of mild steel and decreases as the strength of steel sheets increases. An example of a multi-phase steel sheet having both a high strength and a large static-dynamic difference is a low-alloy TRIP steel sheet.

As a specific example of such a steel sheet, Patent Document 1 discloses a strain induced transformation-type high-strength steel sheet (TRIP steel sheet) having improved dynamic deformation properties which is obtained by pre-straining a steel sheet having a composition comprising, in mass percent, 0.04-0.15% C, one or both of Si and Al in a total of 0.3-3.0%, and a remainder of Fe and unavoidable impurities and having a multi-phase structure comprising a main phase of ferrite and a second phase which includes at least 3 volume percent of austenite. The pre-straining is carried out by one or both of temper rolling and a tension leveling such that the amount of plastic deformation T produced by pre-straining satisfies the following Equation (A). The steel sheet before pre-straining has such a property that the ratio V(10)/V(0) which is the ratio of the volume fraction V(10) of the austenitic phase after deformation at an equivalent strain of 10% to the initial volume fraction V(0) of the austenitic phase is at least 0.3. The steel sheet is characterized in that the difference (σd−σs) between the quasi-static deformation strength as when deformed at a strain rate in the range of $5\times10^{-4}$-$5\times10^{-3}$ ($s^{-1}$) and the dynamic deformation strength ad when deformed at a strain rate in the range of $5\times10^{2}$-$5\times10^{3}$ ($s^{-1}$) after pre-straining in accordance with Equation (A) below is at least 60 MPa. Steel sheets having a multi-phase structure are hereinafter referred to collectively as multi-phase steel sheets.

$$0.5[\{(V(10)/V(0))/C\}-3]+15\geq T\geq 0.5[\{(V(10)/V(0))/C\}-3] \quad (A)$$

As an example of a multi-phase steel sheet having a second phase which is primarily martensite, Patent Document 2 discloses a high-strength steel sheet having an improved balance of strength and ductility and having a static-dynamic difference of at least 170 MPa. The steel sheet comprises fine ferritic grains in which the average grain diameter ds of nanocrystalline grains having a grain diameter of at most 1.2 μm and the average grain diameter dL of microcrystalline grains having a grain diameter exceeding 1.2 μm satisfy dL/ds≥3. In that document, the static-dynamic difference is defined as the difference between the static deformation stress obtained at a strain rate of 0.01 $s^{-1}$ and the dynamic deformation stress obtained when carrying out a tensile test at a strain rate of 1000 $s^{-1}$. However, Patent Document 2 does not contain any disclosure concerning the deformation stress in an intermediate strain rate region where the strain rate is greater than 0.01 $s^{-1}$ and less than 1000 $s^{-1}$.

Patent Document 3 discloses a steel sheet having a high static-dynamic ratio having a dual-phase structure consisting of martensite having an average grain diameter of at most 3 μm and ferrite having an average grain diameter of at most 5 μm. In that document, the static-dynamic ratio is defined as the ratio of the dynamic yield stress obtained at a strain rate of $10^{3}$ $s^{-1}$ to the static yield stress obtained at a strain rate of $10^{-3}$ $s^{-1}$. However, there is no disclosure concerning the static-dynamic difference in a region in which the strain rate is greater than 0.01 $s^{-1}$ and less than 1000 $s^{-1}$. In addition, the static yield stress of the steel sheet disclosed in Patent Document 3 is a low value of 31.9 kgf/$mm^2$-34.7 kgf/$mm^2$.

Patent Document 4 discloses a cold-rolled steel sheet having improved impact absorbing properties in which the structure comprises at least 75% of a ferritic phase having an average grain diameter of at most 3.5 μm and a remainder of tempered martensite. The impact absorbing properties of the cold-rolled steel sheet are evaluated by the absorbed energy when a tensile test is carried out at a strain rate of 2000 $s^{-1}$. However, there is no disclosure in Patent Document 4 concerning the absorbed impact energy in a strain rate region of less than 2000 $s^{-1}$.

PRIOR ART DOCUMENTS

Patent Documents

Patent Document 1: JP 3958842 B
Patent Document 2: JP 2006-161077 A
Patent Document 3: JP 2004-84074 A
Patent Document 4: JP 2004-277858 A

DISCLOSURE OF INVENTION

Prior art steel sheets like those described above have the following problems.

In the past, steel sheets for use as impact members for automobiles are aimed at increasing dynamic strength for the purpose of improving absorption of impact energy.

However, in order to guarantee safety at the time of a collision, it is necessary to improve not only dynamic strength but also uniform ductility and local ductility at a high strain rate (or a high-velocity deformation).

With a multi-phase high-strength steel sheet having a ferritic phase as a main phase and a martensitic phase as a second phase (a DP steel sheet), it is difficult to achieve both formability and impact absorbing properties. In addition, it is difficult to guarantee local ductility.

Accordingly, the object of the present invention is to provide multi-phase steel sheets in the form of a hot-rolled steel sheet, a cold-rolled steel sheet, and a plated steel sheet having improved uniform ductility and local ductility at a high strain rate and a method for the manufacture of these steel sheets.

The present inventors carried out various investigations concerning a method of improving the uniform ductility and local ductility of a multi-phase steel sheet at a high strain rate. As a result, they obtained the following findings.

(1) Toughness at a high strain rate is improved by refining grains.

(2) On the other hand, uniform ductility is worsened by refining grains.

(3) A decrease in uniform ductility is compensated for by dispersing martensite, bainite, or austenite which are harder than ferrite.

(4) In order to improve uniform ductility, it is necessary to disperse a second phase which is as hard as possible, and hard martensite which has a high content of dissolved C is preferred.

(5) However, if the second phase is hard martensite, local ductility is worsened.

(6) If a hardness variation is imparted to the second phase, local ductility increases.

(7) In order to satisfy above (4) and (6), the difference in nanohardness between the first phase which is ferrite and the second phase is made large and the variation of nanohardness is made small in the surface layer of the steel sheet, while the difference in nanohardness is made small and the variation thereof is made large in the central portion of the sheet thickness, thereby making it possible to provide a hot-rolled steel sheet having both uniform ductility and local ductility at a high strain rate.

(8) For a cold-rolled steel sheet manufactured from this hot-rolled steel sheet, uniform ductility and local ductility at a high strain rate are improved by maintaining the nanohardness of the hot-rolled steel sheet in the central portion of the sheet thickness of the cold-rolled steel sheet and by making the second phase rod-shaped or lath-shaped.

Based on these findings, it was found that a steel sheet having improved uniform ductility and local ductility at a high strain rate can be obtained by refining grains and controlling the hardness of the ferritic phase and the second phase in the surface layer and in the central portion of the thickness of the steel sheet.

One mode of the present invention which is provided based on the above findings is a hot-rolled steel sheet having improved uniform ductility and local ductility at a high strain rate and having a metallurgical structure comprising a main phase of ferrite with an average grain diameter of at most 3.0 μm and a second phase including at least one of martensite, bainite, and austenite, characterized in that in a surface layer which is a region from the surface of the steel sheet to a position at a depth of 100 μm from the surface, the average grain diameter of the second phase is at most 2.0 μm, the difference ($\Delta nH_{av}$) between the average nanohardness of ferrite ($nH_{\alpha av}$) which is the main phase and the average nanohardness of the second phase ($nH_{2nd\ av}$) is at least 6.0 GPa to at most 10.0 GPa, the difference ($\Delta\sigma nH$) of the standard deviation of the nanohardness of the second phase from the standard deviation of the nanohardness of ferrite is at most 1.5 GPa, and in a central portion which is a region between a position at a depth of ¼ of the sheet thickness from the surface of the steel sheet to the center of the sheet thickness, the difference ($\Delta nH_{av}$) in the average nanohardness is at least 3.5 GPa to at most 6.0 GPa, and the difference ($\Delta\sigma nH$) in the standard deviations of the nanohardness is at least 1.5 GPa.

According to another mode, the present invention provides a cold-rolled steel sheet having improved uniform ductility and local ductility at a high strain rate and having a metallurgical structure comprising a main phase of ferrite having an average grain diameter of at most 3.0 μm and a second phase including at least one of martensite, bainite, and austenite, characterized in that in a central portion which is a region between a position at a depth of ¼ of the sheet thickness from the surface of the steel sheet to the center of the sheet thickness, the second phase has an average grain diameter of at most 2.0 μm and an aspect ratio (major axis/minor axis ratio) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the difference ($\Delta\sigma nH$) of the standard deviation of the nanohardness of the second phase from the standard deviation of the nanohardness of ferrite is at least 1.5 GPa.

According to yet another mode, the present invention provides a plated steel sheet having improved uniform ductility and local ductility at a high strain rate and having a metallurgical structure comprising a main phase of ferrite having an average grain diameter of at most 3.0 μm and a second phase including at least one of martensite, bainite, and austenite, characterized in that in a central portion which is a region between a position at a depth of ¼ of the sheet thickness from the surface of the steel sheet to the center of the sheet thickness, the second phase has an average grain diameter of at most 2.0 μm and an aspect ratio (major axis/minor axis ratio) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the difference ($\Delta\sigma nH$) of the standard deviation of the nanohardness of the second phase from the standard deviation of the nanohardness of ferrite is at least 1.5 GPa.

The above-described hot-rolled steel sheet, cold-rolled steel sheet, and plated steel sheet may contain, in mass percent, C: at least 0.1% to at most 0.2%, Si: at least 0.1% to at most 0.6%, Mn: at least 1.0% to at most 3.0%, Al: at least 0.02% to at most 1.0%, Cr: at least 0.1% to at most 0.7%, and N: at least 0.002% to at most 0.015%, and they may further contain one or more elements selected from the group consisting of Ti: at least 0.002% to at most 0.02%, Nb: at least 0.002% to at most 0.02%, and V: at least 0.01% to at most 0.1%.

According to still another mode, the present invention provides a method of manufacturing a hot-rolled steel sheet having improved uniform ductility and local ductility at a high strain rate in which a slab obtained by hot forging of a steel material with a reduction in area of at least 30% at a temperature of at least 850° C. is reheated to at least 1200° C. and then subjected to hot continuous rolling, the steel material comprising, in mass percent, C: at least 0.1% to at most 0.2%, Si: at least 0.1% to at most 0.6%, Mn: at least 1.0% to at most 3.0%, Al: at least 0.02% to at most 1.0%, Cr: at least 0.1% to at most 0.7%, and N: at least 0.002% to at most 0.015%, one or more elements selected from the group consisting of Ti: at least 0.002% to at most 0.02%, Nb: at least 0.002% to at most 0.02%, and V: at least 0.01% to at most 0.1%, and a remainder of Fe and impurities, characterized in that the hot continuous rolling comprises a rough rolling step in which the reheated slab is rolled to obtain a steel sheet having an average austenite grain diameter of at most 50 μm, a finish rolling step in which the steel sheet obtained by the rough rolling step is rolled such that the final rolling pass is in the temperature range of from ($Ae_3$−50° C.) to ($Ae_3$+50° C.) with a rolling reduction of at least 17%, and a cooling step in which the steel sheet obtained by the finish rolling step is cooled within 0.4 seconds of the completion of the finish rolling step to 700° C. or below at a cooling rate of at least 600° C./sec, the steel sheet after cooling is held for at least 0.4 seconds in a temperature range of from 600° C. to 700° C., and the steel sheet after holding is cooled to 400° C. or below at a cooling rate of at most 120° C./sec.

The present invention also provides a method of manufacturing a cold-rolled steel sheet in which a hot-rolled steel sheet manufactured by the above-described method of manufacturing a hot-rolled steel sheet is used as a starting material, and the starting material is subjected to cold rolling and continuous annealing to obtain a cold-rolled steel sheet, characterized in that the cold rolling is carried out with a rolling reduction of 50-90%, and in the continuous annealing, the steel sheet after cold rolling is heated and held for from 10 seconds to 150 seconds in a temperature range of from 750° C. to 850° C. and then cooled to a temperature range of 450° C. or below.

The present invention also provides a method of manufacturing a plated steel sheet characterized in that a cold-rolled steel sheet manufactured by the above-described method of manufacturing a cold-rolled steel sheet is subjected to galvanizing (zinc plating) followed by heat treatment for alloying in a temperature range not exceeding 550° C.

According to the present invention, it is possible to stably provide a multi-phase hot-rolled steel sheet, a cold-rolled steel sheet, and a plated steel sheet having improved uniform ductility and local ductility at a high strain rate. If these steel sheets are applied to components of automobiles and the like, they produce extremely beneficial industrial effects such as an expected marked improvement in the safety of products in collisions.

MODES FOR CARRYING OUT THE INVENTION

The present invention has the following 5 features.

(i) Strength, uniform ductility, and local ductility are improved by refining grains.

(ii) Uniform ductility and local ductility at a high strain rate are both achieved by imparting a variation to the properties of the second phase.

(iii) In the surface layer of a steel sheet, the work hardening rate is improved by finely dispersing a hard second phase.

(iv) In the center of the thickness of the steel sheet, local ductility is improved by imparting a variation to the hardness of a slightly soft second phase.

(v) In a cold-rolled steel sheet, the aspect ratio of the second phase is increased.

The properties of the second phase are evaluated by the nanohardness measured by the nanoindentation method. Specifically, a nanohardness measured with an indentation load of 500 μN using a Berkovich tip is employed.

Below, the present invention will be explained in detail. In this description, unless otherwise specified, percent with respect to the content of elements in a chemical composition of steel means mass percent.

1. Metallurgical Structure

A steel sheet according to the present invention has a metallurgical structure comprising a main phase of ferrite having an average grain diameter of at most 3.0 μm and a second phase including at least one of martensite, bainite, and austenite. Due to the presence of the second phase, the proportion of the overall structure constituted by ferrite which is the main phase is preferably at most 80%.

If the ferrite grain diameter exceeds 3.0 μm, local ductility decreases. Accordingly, the average grain diameter of ferrite is made at most 3.0 μm. A lower limit is not specified, but when manufacture is carried out by the below-described manufacturing method according to the present invention, it is normally at least 0.5 μm.

If only a ferritic phase is present, it is difficult to guarantee strength and ductility, so the second phase includes at least one of martensite, bainite, and austenite.

(1) Structure of the Surface Layer in a Hot-Rolled Steel Sheet

A hot-rolled steel sheet according to the present invention has the following characteristics in its surface layer (the region from the surface of the steel sheet to a depth of 100 μm). The average grain diameter of the second phase is at most 2.0 μm, the difference ($\Delta nH_{av}$) between the average nanohardness of ferrite ($nH_{\alpha av}$) which is the main phase and the average nanohardness of the second phase ($nH_{2nd\ av}$) is at least 6.0 GPa to at most 10.0 GPa, and the difference ($\Delta\sigma nH$) of the standard deviation of the nanohardness of the second phase from the standard deviation of the nanohardness of ferrite is at most 1.5 GPa.

When bending deformation or the like is applied, more deformation strains are imparted to the surface layer than in the center of the sheet thickness, so it is necessary to give the surface layer a specialized structure.

By finely dispersing a second phase (martensite, bainite, and/or austenite) which is harder than the ferrite mother phase in the surface layer, the work hardening rate is increased, thereby increasing uniform ductility.

When the value of $\Delta\sigma nH_{av}$ in the surface layer is less than 6.0 GPa, the work hardening rate becomes inadequate. On the other hand, if the value of $\Delta nH_{av}$ in the surface layer exceeds 10.0 GPa, cracks easily develop in the interface between ferrite and the second phase.

When the average grain diameter of the second phase exceeds 2.0 μm, cracks easily develop in the interface between ferrite and the second phase.

In order to guarantee the work hardening rate and uniform ductility, it is necessary to disperse a second phase which is as uniform as possible. Specifically, uniform ductility is worsened if the difference in the standard deviations of the nanohardness ($\Delta\sigma nH$) exceeds 1.5 GPa.

It is not necessary to particularly prescribe the structure of the surface layer of a cold-rolled steel sheet which is obtained by cold rolling of a hot-rolled steel sheet according to the present invention because a cold-rolled steel sheet is often used after performing surface treatment such as pickling or plating, so the properties of the sheet change due to surface treatment.

(2) Structure of the Central Portion in a Steel Sheet According to the Present Invention In a region from (¼)t to (½)t of the sheet thickness of a hot-rolled steel sheet, a cold-rolled steel sheet, and a plated steel sheet according to the present invention (collectively referred to as a steel sheet according to the present invention), namely, in a region from a location at a depth of ¼ of the sheet thickness from the surface of the steel sheet (in the case of a plated steel sheet, from the surface of the steel sheet forming a substrate) to the center of the sheet thickness (referred to below as the central portion), the value of $\Delta nH_{av}$ is at least 3.5 GPa to at most 6.0 GPa and the value of $\Delta \sigma nH$ is at least 1.5 GPa.

If the entire sheet thickness has a structure like the above-described surface layer, local ductility decreases. Accordingly, a steel sheet according to the present invention has a multi-layer structure in which the structure in the central portion is different from the structure in the surface layer or a gradient structure in which the properties of the structure continuously varies from the surface layer to the central portion.

In order to improve local ductility, it is necessary to disperse a relatively soft second phase. Namely, if the value of $\Delta nH_{av}$ in the central portion exceeds 6.0 GPa, local ductility decreases. However, if it is less than 3.5 GPa, strength decreases. In addition, variation in the hardness of the second phase is effective at improving local ductility. Namely, it is not possible to guarantee ductility after the occurrence of necking if the value of $\Delta \sigma nH$ is less than 1.5 GPa.

(3) Grain Diameter and Aspect Ratio of the Second Phase in the Central Portion of a Cold-Rolled Steel Sheet and Plated Steel Sheet In a cold-rolled steel sheet and a plated steel sheet obtained by plating of a cold-rolled steel sheet, the average grain diameter of the second phase in the central portion is at most 2.0 μm. If it exceeds 2.0 μm, cracks easily develop in the interface between ferrite and the second phase. Accordingly, the average grain diameter of the second phase is made at most 2.0 μm. There is no particular lower limit on the average grain diameter of the second phase. When manufacture is carried out by a manufacturing method according to the present invention, it is normally at least 0.5 μm.

Local ductility is increased by changing the shape of the second phase in the central portion from an isometric shape to a rod shape or a lath shape. If the aspect ratio (major axis/minor axis ratio) of the second phase in the central portion is 2 or less, local ductility becomes inadequate. Accordingly, the aspect ratio of the second phase is made greater than 2.

(4) Chemical Composition of the Steel

Below, a preferred chemical composition of a steel sheet according to the present invention will be explained.

C: at least 0.1% to at most 0.2%

Upper and lower limits on the C content are preferably set in order to adjust the contents of ferrite, bainite, martensite, and austenite and to guarantee the static strength and the static-dynamic difference. Namely, if the C content is less than 0.1%, there is a concern of an increased possibility that the expected strength cannot be obtained because solid solution strengthening of ferrite becomes inadequate and none of bainite, martensite, and austenite is formed. On the other hand, if the C content exceeds 0.2%, there is a concern of an increased possibility of a decrease in the static-dynamic difference due to excessive formation of a high hardness phase. Accordingly, the range for the C content is preferably 0.1% to 0.2%.

Si: at least 0.1% to at most 0.6%

Si has the effect of increasing the strength of steel by solid solution strengthening and increasing ductility, and it also has the effect of increasing the static-dynamic difference by suppressing the formation of carbides. Therefore, the Si content is preferably at least 0.1%. However, its effects saturate when it is contained in excess of 0.6%, and there is a concern of an increased possibility of embrittlement of the steel. Accordingly, the range for the Si content is preferably 0.1-0.6%.

Mn: at least 1.0% to at most 3.0%

Mn controls transformation behavior and controls the amount and hardness of a transformed phase which is formed during hot rolling and during a cooling process after hot rolling, so upper and lower limits on the Mn content are preferably set. Namely, if the Mn content is less than 1.0%, there is concern of an increased possibility that a desired strength and static-dynamic difference cannot be obtained because the amounts of a bainitic ferrite phase and a martensitic phase which are formed are reduced. If Mn is added in excess of 3.0%, there is a concern of an increased possibility of a decrease in dynamic strength due to the amount of a martensitic phase which becomes excessive. Accordingly, the range for the Mn content is 1.0-3.0%. More preferably, it is 1.5-2.5%.

Al: at least 0.02% to at most 1.0%

Al acts as a deoxidizer. In addition, it has the effect of increasing the strength and ductility of steel by controlling the amount and hardness of a transformed phase which is formed during hot rolling and during a cooling step after hot rolling. Accordingly, preferably at least 0.02% of Al is contained. However, the effects of Al saturate when it is contained in excess of 1.0%, and there is a concern of an increased possibility of embrittlement of steel. Accordingly, the range for the Al content is preferably 0.02%-1.0%.

Cr: at least 0.1% to at most 0.7%

Cr controls the amount and hardness of a transformed phase which is formed during hot rolling and during a cooling step after hot rolling. Therefore, upper and lower limits on the Cr content are preferably set. Cr has a useful effect of guaranteeing the amount of bainite. In addition, it suppresses precipitation of carbides in bainite. Furthermore, Cr itself has a solid solution strengthening effect.

If the Cr content is less than 0.1%, there is a concern of an increased possibility that a desired strength cannot be obtained. On the other hand, if Cr is added in excess of 0.7%, the above-described effects saturate, and there is a concern of an increased possibility of ferritic transformation being suppressed. Accordingly, the range for the Cr content is preferably 0.1-0.7%.

N: at least 0.002% to at most 0.015%

N is added in order to forms nitrides with Ti or Nb and suppress coarsening of grains. If the N content is less than 0.002%, there is a concern of an increased possibility of coarsening of the structure after hot rolling due to coarsening of grains which may occur at the time of slab heating. On the other hand, if the N content exceeds 0.015%, coarse nitrides are formed, leading to a concern of an increased possibility of an adverse affect on ductility. Accordingly, the range for the N content is preferably 0.002% to 0.015%.

One or more of Ti, Nb, and V is preferably contained.

Ti: at least 0.002% to at most 0.02%

When Ti is added, it forms a nitride. TiN is effective at preventing coarsening of grains. If the Ti content is less than 0.002%, this effect is not obtained. On the other hand, if Ti is added in excess of 0.02%, it forms coarse nitrides and thereby decreases ductility, and there is concern of an increased possibility of ferritic transformation being suppressed. Accordingly, when Ti is added, the added amount is preferably 0.002-0.02%.

Nb: at least 0.002% to at most 0.02%

When Nb is added, it forms a nitride. In the same manner as a Ni nitride, a Nb nitride is effective at preventing coarsening of grains. In addition, Nb forms a Nb carbide, which contribute to preventing coarsening of ferritic phase grains. These effects are not obtained, if its content is less than 0.002%. If Nb is added in excess of 0.02%, there is a concern of an increased possibility of a ferritic transformation being suppressed. Accordingly, when Nb is added, the added amount is preferably 0.002-0.02%.

V: at least 0.01% to at most 0.1%

Carbonitrides of V are effective at preventing coarsening of austenitic phase grains in a low-temperature austenite region. In addition, carbonitrides of V contribute to preventing coarsening of ferritic phase grains. Accordingly, V may be added as necessary. These effects are not achieved if the V content is less than 0.01%. On the other hand, if V is added in excess of 0.1%, precipitates increase and there is a concern of an increased possibility of a decrease in the static-dynamic difference. Accordingly, the added amount of V when it is added is preferably made 0.01-0.1%.

(5) Manufacturing Method (5-1) Method of Manufacturing a Hot-Rolled Steel Sheet

Below, a preferred example of a manufacturing method for manufacturing a hot-rolled steel sheet having the above-described metallurgical structure will be explained. The following manufacturing method is an example, and a hot-rolled steel sheet having the same structure may be manufactured by other manufacturing methods.

First, a slab having the above-described chemical composition which was manufactured by continuous casting undergoes hot forging at a temperature of at least 850° C. A forging temperature of less than 850° C. has a low softening effect of the slab, so forging is carried out at 850° C. or above. There is no upper limit on the forging temperature as long as forging can be carried out, but it is preferably at most 1100° C. There is no limit on the percent reduction in area, but in order to decrease the average grain diameter of austenite after rough rolling, it is preferably at least 30%. The hot forged slab is usually cooled to 700° C. or below by natural cooling or accelerated cooling.

In order to sufficiently soften the slab prior to hot rolling, the slab is reheated to 1200° C. or above. By making the slab temperature at least 1200° C., the structure becomes austenite. During heating, austenite undergoes grain growth, but the grain diameter decreases due to subsequent hot rolling. Hot rolling is carried out in the following manner.

Fiirst rough rolling is carried out to decrease the average austenite grain diameter to at most 50 μm. The austenite grain diameter is then further refined by carrying out finish rolling. The finish rolling is carried out in such a manner that the final rolling pass of the finish rolling is in the temperature range of from ($Ae_3$−50° C.) to ($Ae_3$+50° C.) with a rolling reduction of at least 17%. When the rolling reduction is less than 17%, the prescribed grain diameter and nanohardness of the second phase are not obtained.

Here, $Ae_3$ means the thermal equilibrium temperature at which the steel starts to transform from austenite to ferrite. By carrying out a high degree of reduction in the vicinity of the $Ae_3$ point in the final rolling pass of the finish rolling, refinement of the grain diameter of a hot-rolled steel sheet when it is a final product can be achieved. The $Ae_3$ point is calculated using the thermodynamic calculation software Thermo-Calc (made by Thermo-Calc Software AB) and is the calculated value of $Ae_3$ in a paraequilibrium state. Table 1 shows the $Ae_3$ point for each steel type.

Then, in order to suppress recrystallization of austenite, cooling is started within 0.4 seconds after rolling. This cooling is performed to a temperature of 700° C. or below at a cooling rate of at least 600° C./sec. By carrying out this rapid cooling, recrystallization of austenite can be suppressed and a fine grain structure in which the average grain diameter of ferrite is at most 3.0 μm can be obtained.

In order to produce ferrite from austenite, holding is carried out in a temperature range of 600-700° C. for the length of time necessary for ferritic transformation, namely, for at least 0.4 seconds. Subsequently, cooling is carried out to 400° C. or below at a cooling rate of less than 100° C./sec, whereby the remainder which did not undergo ferritic transformation remains as austenite or is transformed into martensite and/or bainite.

As a result of performing the above-described manufacturing steps, a hot-rolled steel sheet characterized by having the following metallurgical structure can be obtained.

A) The surface layer has the following characteristics:

the average grain diameter of the second phase is at most 2.0 μm, the difference ($\Delta nH_{av}$) between the average nanohardness of ferrite ($nH_{\alpha av}$) which is the main phase and the average nanohardness of the second phase ($nH_{2nd\ av}$) is at least 6.0 GPa to at most 10.0 GPa, and the difference ($\Delta\sigma nH$) of the standard deviation of the nanohardness of the second phase from the standard deviation of the nanohardness of the ferrite is at most 1.5 GPa.

B) The central portion has the following characteristics:

the difference ($\Delta nH_{av}$) in the average nanohardness is at least 3.5 GPa to at most 6.0 GPa, and the difference ($\Delta\sigma nH$) in the standard deviation of the nanohardness is at least 1.5 GPa.

(5-2) Method of Manufacturing a Cold-Rolled Steel Sheet

The above-described hot-rolled steel sheet is used as a starting material, and it is subjected to the below-described cold rolling and continuous annealing to obtain a cold-rolled steel sheet.

The rolling reduction in cold rolling is made 50-90%. By making the rolling reduction in cold rolling at least 50%, it becomes easy to accumulate sufficient work strains in a steel sheet. The upper limit on the rolling reduction is set from the standpoints of manufacturing equipment and/or manufacturing efficiency.

In continuous annealing, the steel sheet obtained by cold rolling is heated and held for at least 10 seconds to at most 150 seconds in a temperature range of 750-850° C., and then it is cooled to a temperature range of 450° C. or below. By holding for 10-150 seconds in a temperature range of 750-850° C. to perform recrystallization, the work strains which are accumulated by the above-described cold rolling obstruct the growth of crystal grains, thereby making it possible to obtain a steel structure having a refined grain diameter.

By carrying out the above-described cold rolling and continuous annealing on a hot-rolled steel sheet which is manufactured in the above-described manner, it is possible to obtain a cold-rolled steel sheet characterized by having the following metallurgical structure.

The central portion has the following characteristics:

it includes a second phase having an average grain diameter of at most 2.0 μm and an aspect ratio (major axis/minor axis) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the above-described difference ($\Delta\sigma nH$) in the standard deviation of the nanohardness is at least 1.5 GPa.

(5-3) Method of Manufacturing a Plated Steel Sheet

A plated steel sheet can be obtained by further performing galvanizing (zinc plating) on the above-described cold-rolled steel sheet. When employing galvanizing, the galvanizing is preferably followed by alloying heat treatment in a temperature range not exceeding 550° C. When performing hot dip galvanizing and alloying heat treatment, it is desirable from the standpoint of productivity to perform from continuous annealing to hot dip galvanizing and the like in a single step using continuous hot dip galvanizing equipment. After plating, it is possible further increase corrosion resistance by carrying out suitable chemical conversion treatment (such as coating with a silicate-based chromium-free chemical conversion treatment solution followed by drying).

Even if plating like that described above is applied to a cold-rolled steel sheet manufactured in the above-described manner, the structure of the cold-rolled steel sheet remains in the resulting plated steel sheet. Therefore, its metallurgical structure is a structure with the following characteristics.

The central portion has the following characteristics:

it includes a second phase having an average grain diameter of at most 2.0 μm and an aspect ratio (major axis/minor axis) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the above-described difference ($\Delta\sigma nH$) in the standard deviation of the nanohardness is at least 1.5 GPa.

EXAMPLES (Hot-Rolled Steel Sheet)

Experiments were carried out using slabs made from steel types A, B, C, D, and E having the chemical compositions shown in Table 1 (thickness of 35 mm, width of 160-250 mm, length of 70-90 mm). Steel types A-C and E had chemical compositions within the range defined by the present invention, and steel D had a chemical composition outside the range of the present invention.

TABLE 1

| Steel type | C | Si | Mn | P | S | Cr | Ti | Nb | V | Al | N | $Ae_3$ |
|---|---|---|---|---|---|---|---|---|---|---|---|---|
| A | 0.15 | 0.54 | 2.02 | 0.001 | 0.002 | 0.25 | 0.010 | — | — | 0.035 | 0.0025 | 845 |
| B | 0.15 | 0.53 | 2.04 | 0.001 | 0.002 | 0.25 | 0.010 | 0.008 | — | 0.033 | 0.0021 | 841 |
| C | 0.15 | 0.52 | 2.01 | 0.002 | 0.002 | 0.25 | 0.010 | — | 0.05 | 0.033 | 0.0030 | 847 |
| D | 0.16 | 0.51 | 2.01 | 0.013 | 0.002 | 0.51 | 0.057 | 0.008 | — | 0.017 | 0.0046 | 838 |
| E | 0.15 | 0.53 | 2.04 | 0.001 | 0.002 | 0.25 | — | 0.008 | — | 0.033 | 0.0021 | 840 |

For each of the steels, 150 kg of steel obtained by vacuum melting underwent hot forging and hot rolling under the conditions shown in Table 2 to obtain a steel sheet sample for testing. The finished thickness of the steel test was 1.6-2.0 mm.

TABLE 2

| | | Forging | | | Hot rolling | | | | |
|---|---|---|---|---|---|---|---|---|---|
| | | | | | | Rough rolling | | Finish rolling | |
| Test No. | Steel type | Heating temp. (° C.) | % Reduction in area at 850° C. or above | Cooling temp. of forged steel | Heating temp. (° C.) | Number of passes | γ grain diameter after rough rolling (μm) | Number of passes | Rolling reduction in each pass |
| 1 | A | 1250 | 50 | RT | 1250 | 4 | 35 | 3 | 30%-30%-30% |
| 2 | A | 1250 | 50 | RT | 1250 | 4 | 35 | 3 | 30%-30%-30% |
| 3 | A | 1250 | 0 | RT | 1250 | 4 | 70 | 3 | 30%-30%-30% |
| 4 | A | 1250 | 50 | RT | 1250 | 1 | 120 | 3 | 30%-30%-30% |
| 5 | A | 1250 | 50 | RT | 1250 | 4 | 35 | 3 | 23%-23%-10% |
| 6 | B | 1250 | 50 | RT | 1250 | 4 | 25 | 3 | 30%-30%-30% |
| 7 | C | 1250 | 50 | RT | 1250 | 4 | 30 | 3 | 30%-30%-30% |
| 8 | D | 1250 | 0 | RT | 1250 | 4 | 35 | 3 | 20%-20%-13% |
| 9 | E | 1250 | 50 | RT | 1250 | 4 | 25 | 3 | 30%-30%-30% |

| | Hot rolling | | | | |
|---|---|---|---|---|---|
| | Temp. at | Cooling conditions | | | |
| Test No. | completion of finish rolling (° C.) | Time until start of cooling (sec) | Temp. at completion of cooling (° C.) | Intermediate cooling time (sec) | Average cooling rate to 400° C. (° C./sec) |
| 1 | 800 | 0.1 | 650 | 0.5 | 42 |
| 2 | 790 | 0.5 | 650 | 0.5 | 250 |
| 3 | 850 | 0.1 | 650 | 0.5 | 45 |
| 4 | 850 | 0.1 | 650 | 0.5 | 40 |
| 5 | 850 | 0.1 | 650 | 0.5 | 40 |

TABLE 2-continued

| | | | | | |
|---|---|---|---|---|---|
| 6 | 870 | 0.1 | 650 | 0.5 | 62 |
| 7 | 820 | 0.1 | 650 | 0.5 | 65 |
| 8 | 850 | 0.1 | — | — | — |
| 9 | 870 | 0.1 | 650 | 0.5 | 62 |

Test Nos. 1, 6, 7, and 9 were samples of steel sheets manufactured by a manufacturing method according to the present invention. In contrast, Test Nos. 2-5 and 8 were samples of steel sheets manufactured by a manufacturing method having conditions outside the range defined by the present invention.

Table 3 shows the results of measurement of the structure of each steel test sample. The grain diameter was determined from a two-dimensional image taken using a scanning electron microscope (SEM) at a magnification of 3000×. The nanohardness of ferrite and of the hard phase was determined by the nanoindentation method. A cross section of a sample steel sheet in the rolling direction was polished with emery paper, and then it was subjected to mechanochemical polishing with colloidal silica and electropolishing to remove a deformed layer before it is subjected to measurement. The measurement by the nanoindentation method was carried out using a Berkovich tip with an indentation load of 500 μN. The indentation at this time had a diameter of at most 0.1 μm. The nanohardness of each phase was measured at 20 random points positioned at different depths from the surface in a cross section of the steel sheet, and the result underwent statistical treatment to obtain the difference ($\Delta nH_{av}$) in nanohardness between ferrite and the second phase and the difference ($\Delta \sigma nH$) in standard deviation of the nanohardness between them (second phase minus ferrite).

TABLE 3

| | | Average | Surface layer | | | | | | Central portion | | | | | | |
|---|---|---|---|---|---|---|---|---|---|---|---|---|---|---|---|
| Test No. | Steel type | ferrite grain diameter for entire sheet (μm) | Average ferrite grain diameter (μm) | Average grain diameter of 2nd phase (μm) | $nH_{\alpha av}$ (GPa) | $nH_{2nd\ av}$ (GPa) | Δ $nH_{av}$ (GPa) | Δ σnH (GPa) | Average ferrite grain diameter (μm) | Average grain diameter of 2nd phase (μm) | $nH_{\alpha av}$ (GPa) | $nH_{2nd\ av}$ (GPa) | Δ $nH_{av}$ (GPa) | Δ σnH (GPa) | Remark |
| 1 | A | 1.3 | 1.2 | 0.6 | 3.4 | 11.3 | 7.9 | 0.76 | 1.4 | 1.6 | 3.4 | 8.4 | 4.9 | 2.1 | Inventive |
| 2 | A | 3.0 | 2.5 | 2.3 | 3.6 | 8.5 | 5.0 | 0.81 | 3.5 | 4.3 | 3.2 | 7.9 | 4.6 | 0.96 | Compar. |
| 3 | A | 1.4 | 1.2 | 1.1 | 2.9 | 8.3 | 5.5 | 1.1 | 1.5 | 1.5 | 3.2 | 8.2 | 5.2 | 2.3 | Compar. |
| 4 | A | 2.8 | 2.6 | 2.5 | 3.5 | 8.4 | 4.9 | 0.95 | 2.9 | 3.2 | 3.3 | 8.1 | 4.2 | 2.0 | Compar. |
| 5 | A | 2.5 | 2.5 | 2.3 | 3.5 | 8.6 | 5.1 | 0.89 | 2.8 | 4.1 | 3.4 | 7.9 | 4.3 | 1.8 | Compar. |
| 6 | B | 1.0 | 0.8 | 0.5 | 3.6 | 12.4 | 8.7 | 0.85 | 1.2 | 0.9 | 3.7 | 8.6 | 4.7 | 2.6 | Inventive |
| 7 | C | 1.0 | 0.9 | 0.7 | 3.5 | 13.7 | 10.0 | 0.55 | 1.0 | 1.2 | 3.4 | 8.3 | 4.8 | 3.1 | Inventive |
| 8 | D | 1.7 | 1.5 | 0.3 | 4.5 | 5.6 | 1.0 | 0.65 | 1.8 | 3.5 | 4.7 | 5.6 | 0.9 | 0.75 | Compar. |
| 9 | E | 1.2 | 1.0 | 0.5 | 3.5 | 11.8 | 8.3 | 0.81 | 1.3 | 1.2 | 3.5 | 8.5 | 4.8 | 2.3 | Inventive |

Table 4 shows the properties of the resulting steel sheets.

TABLE 4

| | | Quasistatic deformation properties (strain rate: 0.01 $s^{-1}$) | | | | Dynamic deformation properties (strain rate: 100 $s^{-1}$) | | |
|---|---|---|---|---|---|---|---|---|
| Test No. | Steel type | Tensile strength (MPa) | Uniform elongation (%) | Local elongation (%) | Bending properties | Tensile strength (MPa) | Uniform elongation (%) | Local elongation (%) |
| 1 | A | 923 | 27 | 18 | ○ | 1027 | 28 | 19 |
| 2 | A | 999 | 23 | 7 | x | 1017 | 28 | 2 |
| 3 | A | 913 | 28 | 12 | ○ | 1026 | 30 | 3 |
| 4 | A | 901 | 26 | 11 | ○ | 1125 | 17 | 0 |
| 5 | A | 952 | 18 | 12 | ○ | 1111 | 23 | 5 |
| 6 | B | 925 | 25 | 15 | ○ | 1036 | 24 | 15 |
| 7 | C | 913 | 23 | 11 | ○ | 1020 | 26 | 10 |
| 8 | D | 1003 | 24 | 3 | x | 1053 | 22 | 3 |
| 9 | E | 924 | 26 | 16 | ○ | 1032 | 26 | 17 |

The tensile properties were evaluated by a quasistatic tensile test at a strain rate of 0.01 $s^{-1}$ and a dynamic tensile test at a strain rate of 100 $s^{-1}$ both using a test piece with a gauge length of 4.8 mm and a gauge width of 2 mm. The dynamic tensile test was performed using a stress sensing block material testing machine.

Bending properties were evaluated by carrying out 180° contact bending at an average strain rate of 0.01 $s^{-1}$ and visually observing whether there were cracks. In Table 4, cases in which cracks were not observed are shown as ○ and cases in which cracks were observed are shown as x.

The steel sheets of Test Nos. 1, 6, 7, and 9 that were manufactured by a manufacturing method according to the present invention had a tensile strength of at least 900 MPa, uniform elongation of at least 23%, local elongation of at least 10%, and good bending properties under both quasistatic deformation and dynamic deformation. The steel sheets of Test Nos. 2-5 and 8 which were manufactured by a manufacturing method for which the conditions were outside the range defined by the present invention had a good tensile strength, but uniform elongation, local elongation, and/or bending properties were inadequate.

(Cold-Rolled Steel Sheet and Plated Steel Sheet)

The hot-rolled steel sheets which were manufactured by the above-described method were subjected to cold rolling and then to heat treatment which simulated the heat pattern in continuous hot dip galvanizing equipment using a continuous annealing simulator.

Table 5 shows the methods of manufacturing hot-rolled steel sheets which were subjected to cold rolling, and Table 6 shows the rolling conditions for cold rolling and the conditions for heat treatment corresponding to continuous annealing and alloying treatment after plating. The structure of the resulting steel sheets was measured in the same manner as for the above-described hot-rolled steel sheets. The average aspect ratio of the second phase in the central portion was found from the SEM image used for measurement of the average grain diameter.

TABLE 5

| | | Forging | | | Hot rolling | | | | |
|---|---|---|---|---|---|---|---|---|---|
| | | | | | Rough rolling | | | Finish rolling | |
| Test No. | Steel type | Heating temp. (° C.) | % Reduction in area at 850° C. or above | Cooling temp. of forged steel | Heating temp. (° C.) | Number of passes | γ grain diameter after rough rolling (μm) | Number of passes | Rolling reduction in each pass |
| 10 | B | 1250 | 50 | RT | 1250 | 4 | 25 | 3 | 30%-30%-30% |
| 11 | B | 1250 | 50 | RT | 1250 | 4 | 25 | 3 | 30%-30%-30% |
| 12 | D | 1250 | 50 | RT | 1250 | 4 | 25 | 3 | 30%-30%-30% |
| 13 | B | 1250 | 50 | RT | 1250 | 4 | 25 | 3 | 30%-30%-30% |

| | Hot rolling | | | | |
|---|---|---|---|---|---|
| | Temp. at | Cooling conditions | | | |
| Test No. | completion of finish rolling (° C.) | Time until start of cooling (sec) | Temp. at completion of cooling (° C.) | Intermediate cooling time (sec) | Average cooling rate to 400° C. (° C./sec) |
| 10 | 870 | 0.1 | 650 | 0.5 | 62 |
| 11 | 870 | 0.1 | 650 | 0.5 | 120 |
| 12 | 850 | 0.1 | 650 | 0.5 | 70 |
| 13 | 870 | 0.1 | 650 | 0.5 | 62 |

TABLE 6

| Test No. | Steel type | Reduction in cold rolling | Annealing temp. | Annealing time | Heat treatment temperature for alloying | Total time for alloying heat treatment |
|---|---|---|---|---|---|---|
| 10 | B | 55% | 800° C. | 120 sec | 400-450° C. | 300 sec |
| 11 | B | 55% | 780° C. | 120 sec | 350-400° C. | 300 sec |
| 12 | D | 35% | 900° C. | 120 sec | 400-420° C. | 300 sec |
| 13 | B | 35% | 900° C. | 120 sec | 400-420° C. | 300 sec |

Table 7 shows the results of measurement of the metallurgical structure of the steel test samples. Table 8 shows the mechanical properties of the resulting steel sheets. The results shown in Table 8 are the results for steel sheets after carrying out heat treatment corresponding to alloying heat treatment. It is thought that even if plating treatment and alloying heat treatment are carried out, the structure of the original cold-rolled steel sheet remains and the same properties are exhibited, so measurement of the structure and properties of the steel sheets (cold-rolled steel sheets) before carrying out heat treatment corresponding to plating was omitted.

TABLE 7

| | | Central portion | | | | | | | |
|---|---|---|---|---|---|---|---|---|---|
| Test No. | Steel type | Average ferrite grain diameter (μm) | Average grain diameter of 2nd phase (μm) | $nH_{\alpha av}$ (GPa) | $nH_{2nd\ av}$ (GPa) | $\Delta nH_{av}$ (GPa) | $\Delta\sigma nH$ (GPa) | Aspect ratio of 2nd phase | Remark |
| 10 | B | 2.3 | 1.8 | 3.2 | 7.9 | 4.7 | 1.9 | 2.5 | Inventive |
| 11 | B | 2.5 | 1.5 | 3.1 | 7.5 | 4.4 | 2.1 | 3.5 | Inventive |
| 12 | D | 3.5 | 0.8 | 3.1 | 11.8 | 8.7 | 2.3 | 1.2 | Compar. |
| 13 | B | 3.1 | 1.3 | 3.1 | 9.9 | 6.7 | 2.1 | 1.9 | Compar. |

TABLE 8

| | | Quasistatic deformation properties (strain rate: 0.01 $s^{-1}$) | | | | Dynamic deformation properties (strain rate: 100 s−1) | | |
|---|---|---|---|---|---|---|---|---|
| Test No. | Steel type | Tensile strength (MPa) | Uniform elongation (%) | Local elongation (%) | Bending properties | Uniform elongation (%) | Tensile strength (MPa) | Uniform elongation (%) |
| 10 | B | 968 | 27 | 18 | ○ | 1111 | 23 | 19 |
| 11 | B | 975 | 23 | 17 | ○ | 1022 | 28 | 14 |
| 12 | D | 1023 | 18.2 | 6.1 | x | 1026 | 14.3 | 3 |
| 13 | B | 945 | 20 | 8.8 | x | 999 | 18.5 | 7 |

The steel sheets of Test Nos. 10 and 11 which were manufactured by the manufacturing method according to the present invention maintained a tensile strength of at least 900 MPa, uniform elongation of at least 23%, local elongation of at least 10% under both quasistatic deformation and dynamic deformation, and had good bending properties. In contrast, the steel sheets of Test Nos. 12 and 13 which were manufactured by manufacturing methods having conditions outside the range defined by the present invention had good tensile strength, but the uniform elongation, local elongation, and/or bending properties were inadequate.

The invention claimed is:

1. A hot-rolled steel sheet having uniform elongation of at least 23% and local elongation of at least 10% under a dynamic tensile test at a strain rate of 100 $s^{-1}$ and which comprises a main phase of ferrite and a second phase including at least one of martensite, bainite, and austenite, wherein in a surface layer of the steel sheet which is a region between the surface of the steel sheet and a location at a depth of 100 μm from the surface, the main phase has an average grain diameter of at most 1.2 μm, the second phase has an average grain diameter of at most 0.7 μm, the difference ($\Delta nH_{av}$) between the average nanohardness of ferrite ($nH_{\alpha av}$) which is the main phase and the average nanohardness of the second phase ($nH_{2nd\ av}$) is at least 6.0 GPa to at most 10.0 GPa, and the difference ($\Delta\sigma nH$) of the standard deviation of the nanohardness of the second phase from the standard deviation of the nanohardness of the ferrite is at most 1.5 GPa, and in a central portion of the steel sheet which is a region from a location at a depth of ¼ of the sheet thickness from the surface of the steel sheet to the center of the sheet thickness, the above-described difference ($\Delta nH_{av}$) in the average nanohardness is at least 3.5 GPa to at most 6.0 GPa and the above-described difference ($\Delta\sigma nH$) in the standard deviation of the nanohardness is at least 1.5 GPa.

2. A cold-rolled steel sheet produced by cold rolling the hot-rolled steel sheet according to claim 1, having uniform elongation of at least 23% and local elongation of at least 10% under a dynamic tensile test at a strain rate of 100 $s^{-1}$ and which comprises a main phase of ferrite having an average grain diameter of at most 3.0 μm and a second phase including at least one of martensite, bainite, and austenite, wherein in a central portion of the steel sheet which is a region from a location at a depth of ¼ of the sheet thickness from the surface of the steel sheet to the center of the sheet thickness, the second phase has an average grain diameter of at most 2.0 μm and an aspect ratio (major axis/minor axis) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the difference ($\Delta\sigma nH$) of the standard deviation of the nanohardness of the second phase from the standard deviation of the nanohardness of the ferrite is at least 1.5 GPa.

3. A plated steel sheet produced by plating the cold-rolled steel sheet according to claim 2, having improved uniform elongation of at least 23% and local elongation of at least 10% under a dynamic tensile test at a strain rate of 100 $s^{-1}$ and which comprises a main phase of ferrite having an average grain diameter of at most 3.0 μm and a second phase including at least one of martensite, bainite, and austenite, wherein in a central portion of the steel sheet which is a region from a location at a depth of ¼ of the sheet thickness from the surface of the steel sheet to the center of the sheet thickness, the second phase has an average grain diameter of at most 2.0 μm and an aspect ratio (major axis/minor axis) of greater than 2, the difference ($\Delta nH_{av}$) between the average nanohardness of ferrite ($nH_{\alpha av}$) which is the main phase and the average nanohardness of the second phase ($nH_{2nd\ av}$) is at least 3.5 GPa to at most 6.0 GPa, and the difference ($\Delta\sigma nH$) of the standard deviation of the nanohardness of the second phase from the standard deviation of the nanohardness of the ferrite is at least 1.5 GPa.

4. A hot-rolled steel sheet as set forth in claim 1, containing, in mass percent, C: at least 0.1% to at most 0.2%,
Si: at least 0.1% to at most 0.6%,
Mn: at least 1.0% to at most 3.0%,
Al: at least 0.02% to at most 1.0%,
Cr: at least 0.1% to at most 0.7%, and
N: at least 0.002% to at most 0.015%,
and further containing at least one element selected from
Ti: at least 0.002% to at most 0.02%,
Nb: at least 0.002% to at most 0.02%, and
V: at least 0.01% to at most 0.1%.

5. A cold-rolled steel sheet as set forth in claim 2, containing, in mass percent, C: at least 0.1% to at most 0.2%,
Si: at least 0.1% to at most 0.6%,
Mn: at least 1.0% to at most 3.0%,
Al: at least 0.02% to at most 1.0%,
Cr: at least 0.1% to at most 0.7%, and
N: at least 0.002% to at most 0.015%,
and further containing at least one element selected from
Ti: at least 0.002% to at most 0.02%,
Nb: at least 0.002% to at most 0.02%, and
V: at least 0.01% to at most 0.1%.

6. A plated steel sheet as set forth in claim 3, containing, in mass percent, C: at least 0.1% to at most 0.2%,
Si: at least 0.1% to at most 0.6%,
Mn: at least 1.0% to at most 3.0%,
Al: at least 0.02% to at most 1.0%,
Cr: at least 0.1% to at most 0.7%, and
N: at least 0.002% to at most 0.015%,
and further containing at least one element selected from
Ti: at least 0.002% to at most 0.02%,
Nb: at least 0.002% to at most 0.02%, and
V: at least 0.01% to at most 0.1%.

* * * * *